US006830211B2

(12) United States Patent
Sloan

(10) Patent No.: US 6,830,211 B2
(45) Date of Patent: Dec. 14, 2004

(54) FENCE WIRE WINDER

(76) Inventor: Randall L. Sloan, 405 Hill Dr., Craig, CO (US) 81625

( * ) Notice: Subject to any disclaimer, the term of this patent is extended or adjusted under 35 U.S.C. 154(b) by 0 days.

(21) Appl. No.: 10/178,811

(22) Filed: Jun. 24, 2002

(65) Prior Publication Data

US 2003/0234316 A1 Dec. 25, 2003

(51) Int. Cl.[7] ..... B65H 75/24
(52) U.S. Cl. ..... 242/573.1; 242/573.9
(58) Field of Search ..... 242/573.1, 573.9, 242/576.1, 557, 573.7, 573, 390.7, 394

(56) References Cited

U.S. PATENT DOCUMENTS

| | | | | | |
|---|---|---|---|---|---|
| 2,187,138 | A | * | 1/1940 | Potdevin | 242/573.1 |
| 2,338,513 | A | * | 1/1944 | Helm | 242/571 |
| 2,598,398 | A | * | 5/1952 | Littell | 242/573.7 |
| 2,707,599 | A | | 5/1955 | Snyder | |
| 2,912,183 | A | | 11/1959 | Hull | |
| 2,952,418 | A | * | 9/1960 | Rice | 242/573.9 |
| 3,052,420 | A | * | 9/1962 | Roberts | 242/573.4 |
| 3,645,465 | A | * | 2/1972 | Peery | 242/573.9 |
| 3,815,839 | A | * | 6/1974 | Madachy | 242/571.1 |
| 3,827,648 | A | * | 8/1974 | Rafaat | 242/74 |
| 4,050,643 | A | * | 9/1977 | Secor | 242/576.1 |
| 4,201,352 | A | * | 5/1980 | Madachy | 242/419.4 |
| 5,388,782 | A | * | 2/1995 | King | 242/557 |
| 5,772,151 | A | | 6/1998 | Teng | |
| 5,806,779 | A | * | 9/1998 | Crum | 242/399.1 |
| 5,904,315 | A | | 5/1999 | McInerney | |
| 5,984,544 | A | | 11/1999 | Lippold et al. | |
| 5,996,929 | A | | 12/1999 | Mazodier et al. | |
| 6,543,713 | B1 | * | 4/2003 | Frolander et al. | 242/399.1 |

FOREIGN PATENT DOCUMENTS

| | | | | |
|---|---|---|---|---|
| EP | 0096494-a2 | * | 5/1983 | B41J/15/16 |
| JP | 04089131-a | * | 3/1992 | B65H/19/22 |

* cited by examiner

*Primary Examiner*—Kathy Matecki
*Assistant Examiner*—Sang Kim
(74) *Attorney, Agent, or Firm*—Margaret Polson; Patent Law Offices of Rick Martin, P.C.

(57) ABSTRACT

A fence winding reel device including a rotatable frame with a slotted groove along its length and a pair of curved plates, together which comprise an expandable core. In an expanded position, a pair of expanders holds the pair of curved plates away the frame. An end of fence wire is placed into the slotted groove of the frame. The reel device may be connected to any standard earth auger mounted on a skid-steer loader. As the auger motor rotates, fence wire is wound around the expandable core to form a wound fence coil. Removing the fence coil from the reel device involves contracting the core, which narrows the distance between the expanders and the frame, and sliding the coil off the core and out of the frame groove. The reel device may also be used to lay down fence wire by operating the auger motor in a reverse rotational direction. A hydraulic core expander is also depicted.

7 Claims, 6 Drawing Sheets

FENCE WIRE WINDER

FIELD OF INVENTION

The present invention relates to farm equipment for handling wire fences, especially for laying or retrieving wire fences. An auger fixture on a Bobcat® or other skidsteer loader is used to rotate a reel having an expandable core, wherein the reel retrieves a wire fence off the ground, or lays a roll of fencing down.

BACKGROUND OF THE INVENTION

One of the most difficult farm tasks is the unwinding, laying and stretching of woven wire prior to its fastening onto the posts. While wire strand fence and barb wire may be extended over a ground area by two men using a shaft rod through the wire spool and then walking the proposed fence line, woven wire presents almost insurmountable problems due to its weight and inherent stiffness which resists unreeling. Obviously, the rewinding of the woven wire, if it is desired to take up the fence, presents even more of a problem.

U.S. Pat. No. 2,912,183 (1959) to Hull discloses a two-wheeled carriage towed behind a farm tractor. The carriage carries a spool that can wind up or lay out barbed wire or straight wire fencing. The device consists of many parts to accomplish its tasks.

The present invention is a spool that is placed onto an auger attachment on a Bobcat® or other skidsteer loader. The auger attachment is generally used to rotate a drill into the earth. The present invention uses the auger attachment to rotate the spool. The spool has an expandable core that uses wedges to expand the core while reeling the fencing in or out. When the fencing roll is ready to be disengaged, the core is reduced.

SUMMARY OF THE INVENTION

The main aspect of the present invention is to implement a fence winding system to lay or retrieve wire fences using a rotatable reel having an expandable core, the reel being driven by an auger drive assembly on a tractor.

Another aspect of the present invention is to provide an operator the ability to pick up and wind fence into a compact cylindrical coil for disposal or recycling without the need of hauling a trailer.

Another aspect of the present invention is to provide a fence handling attachment that may be easily attached or detached from a Bobcat® or other skidsteer loader.

Another aspect of the present invention is to provide a fence handling attachment that is economical in manufacture and durable in use.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
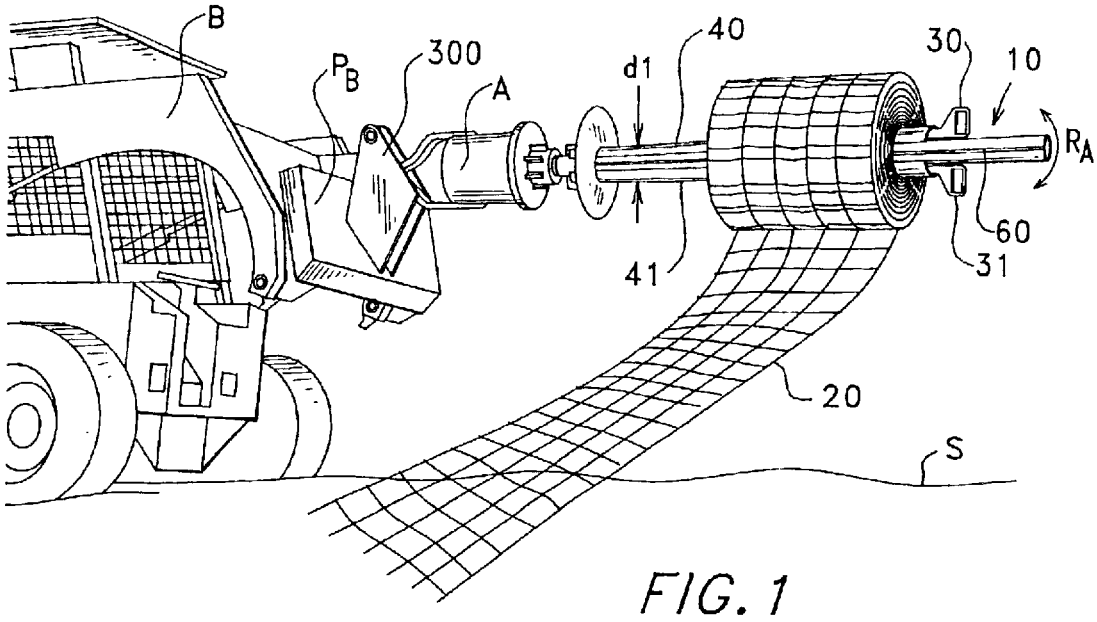
FIG. 1 is a left side perspective view of a fence winding reel, the preferred embodiment mounted on a Bobcat®.

FIG. 1 is a left side perspective view of the fence winding reel 10 mounted on a skidsteer loader B. In this example, the skidsteer loader B employs a McMillan® brand earth auger A fixture to retrieve a wire fence 20 off the ground surface S or lay a roll of fencing down depending on the direction of the auger rotation $R_A$. Wedges 30, 31 of the fence winding reel 10 hold expanders 40, 41 out at a winding diameter, d1, the expanded core position. A starter groove 60 holds one end of the wire fence 20. FIG. 1 also shows the earth auger fixture A mounted to a backing plate $P_B$ which attaches universally to the skidsteer loader B.

Figure 12A:
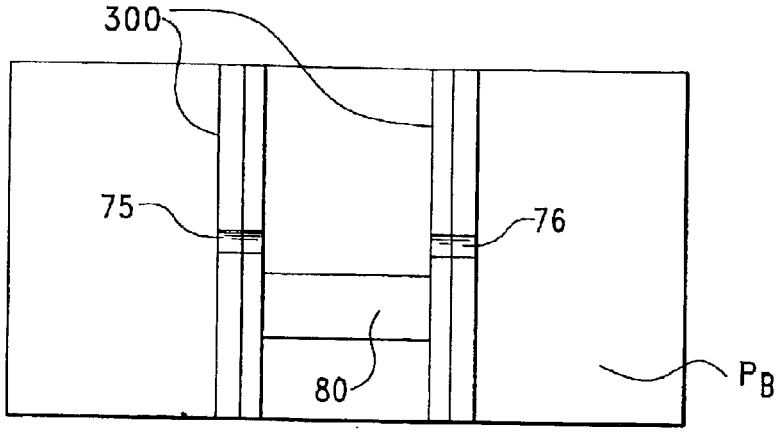
FIG. 12A is a front view of backing plate $P_B$ which has been modified to engage auger fixture A.
Figure 12B:
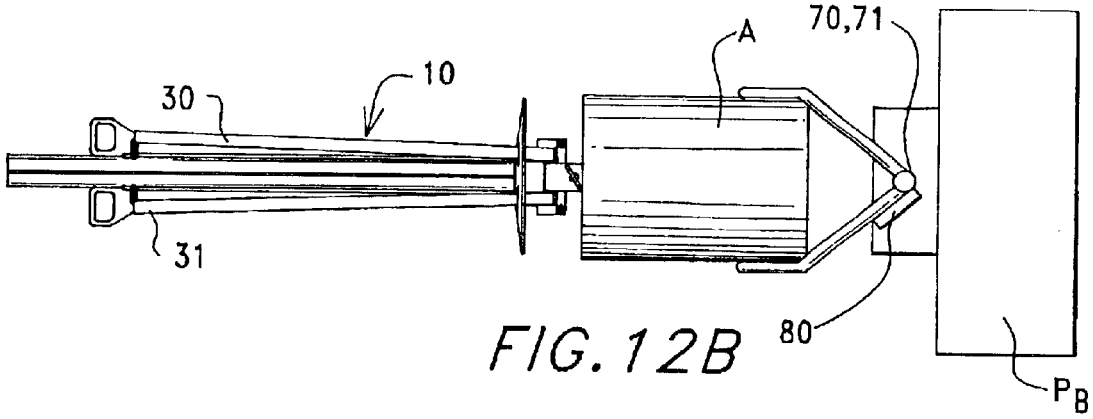
FIG. 12B is a side perspective view of reel 10 mounted to auger fixture A.

To use the fence winding reel 10 in conjunction with the earth auger fixture A, the backing plate $P_B$ may need to be modified. Auger fixture A is mounted to backing plate $P_B$ by inserting mounting pins 70, 71 (See FIGS. 12A, 12B) through mounting pin holes 75,76 located on two adjacent plates of a trapezoidal front portion 300 of the backing plate $P_B$. As seen in FIGS. 12A and 12B, a stopper plate 80 may be welded onto backing plate $P_B$ at a location between the plates of front portion 300 and below pin holes 75, 76 to support auger A out in a horizontal position.

When backing plate $P_B$ is tilted in a forward position on the skidsteer loader B, an operator may remove fence winding reel 10, install a different auger fixture, e.g., a post hole driller, and proceed to drill holes. To alternate to a fence winding function, an operator tilts backing plate $P_B$ in a forward position, removes the auger fixture in use, installs fence winding reel 10, and proceeds to spool up the fence wire 20. Various functions may be performed through the use of the same backing plate $P_B$ and the same auger head, in this case, the auger fixture A.

Other types of earth augers may be used to perform the fence winding function. For example, a skidsteer loader operator may employ a round shaft earth auger fixture C (See FIG. 13). The round shaft earth auger fixture C is mounted to backing plate $P_B$ by inserting mounting pins 90, 91 (See FIGS. 11, 13) through mounting pin holes 95,96 located on an auger adapter 200. Auger fixture C is mounted between two adjacent plates of trapezoidal front portion 300 of the backing plate $P_B$.

Figure 2:
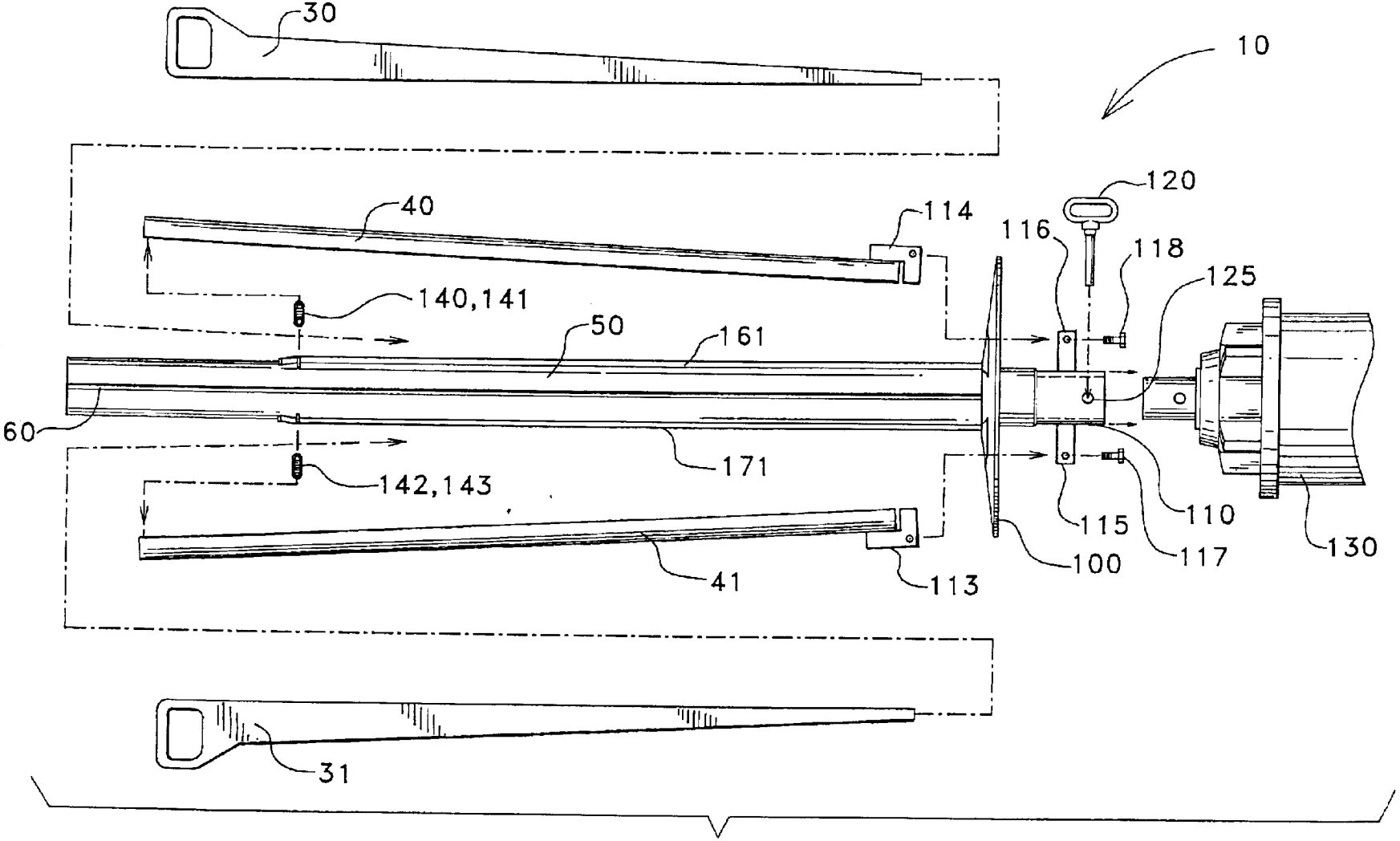
FIG. 2 is an exploded view of the fence winding reel shown in FIG. 1.
Figure 4:
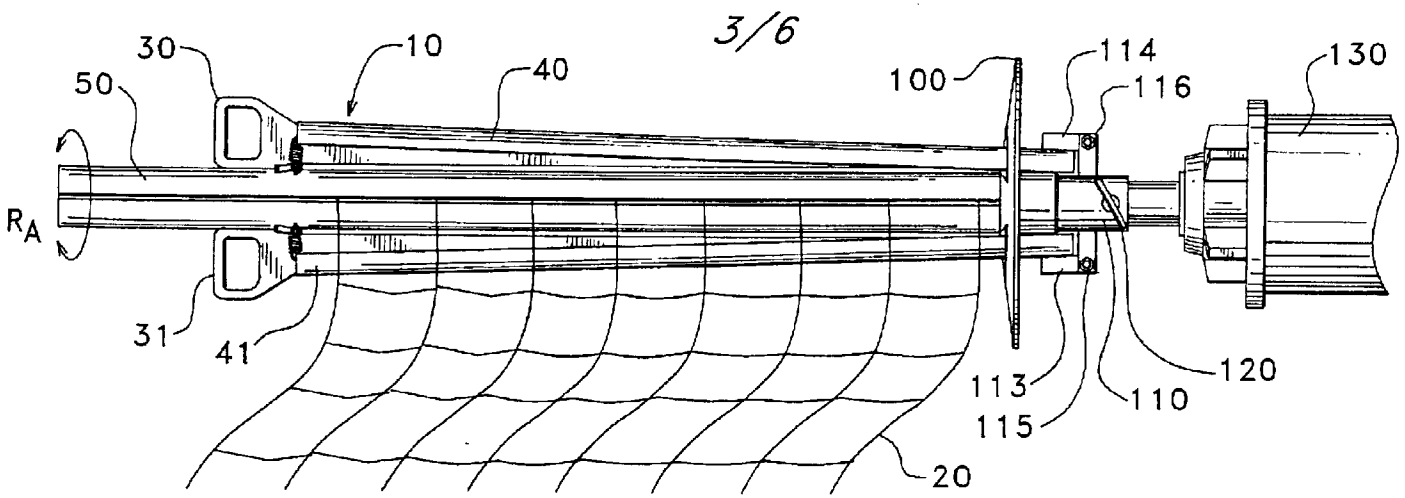
FIG. 4 is a side plan view of the reel apparatus of FIG. 1 with the core in the expanded position.

FIG. 2 is an exploded view of a fence winding reel 10. Expanders 40, 41 having hinged ends 113, 114, are connected through a hole in backing plate 100 and hinged to mounting flange 110 by means of expander hinges 115, 116 and expander hinge pins 117, 118. FIG. 4 shows an assembled view of expanders 40, 41. Mounting pin 120 is inserted into a mounting pin hole 125 to connect fence winding reel 10 to an auger motor 130.

Expanders 40, 41 are positioned adjacent to main frame 50 of fence winding reel 10. Main frame 50 is connected to backing plate 100 and mounting flange 110, preferably by welding. Expander springs 140, 141 provide tension spacing between expander 40 and a top portion of main frame 50 while expander springs 142, 143 provide tension spacing between expander 41 and a corresponding bottom portion of main frame 50. Wedges 30, 31 of the fencing winding reel 10 are used to hold expanders 40, 41 away from main frame 50. Wedge 30 is inserted into a wedge runner guide assembly 160 which includes a first portion 161 located along the length of main frame 50 and a second portion 162 located along the adjacent length of expander 40 (See FIG. 3). Wedge guide assembly 160 is located in the spacing provided by expander springs 140, 141 between main frame 50 and expander 40. Wedge 31 is inserted into a wedge runner guide assembly 170 which includes a first portion 171 located along the length of main frame 50 and a second portion 172 located along the adjacent length of expander 41 (See FIG. 3). Wedge guide assembly 170 is located in the spacing provided by expander springs 142, 143 between main frame 50 and expander 41. Starter groove 60 having a mounting flange end and an opposite open end is located along the length of main frame 50. The mounting flange end of groove 60 begins at backing plate 100.

Figure 3:
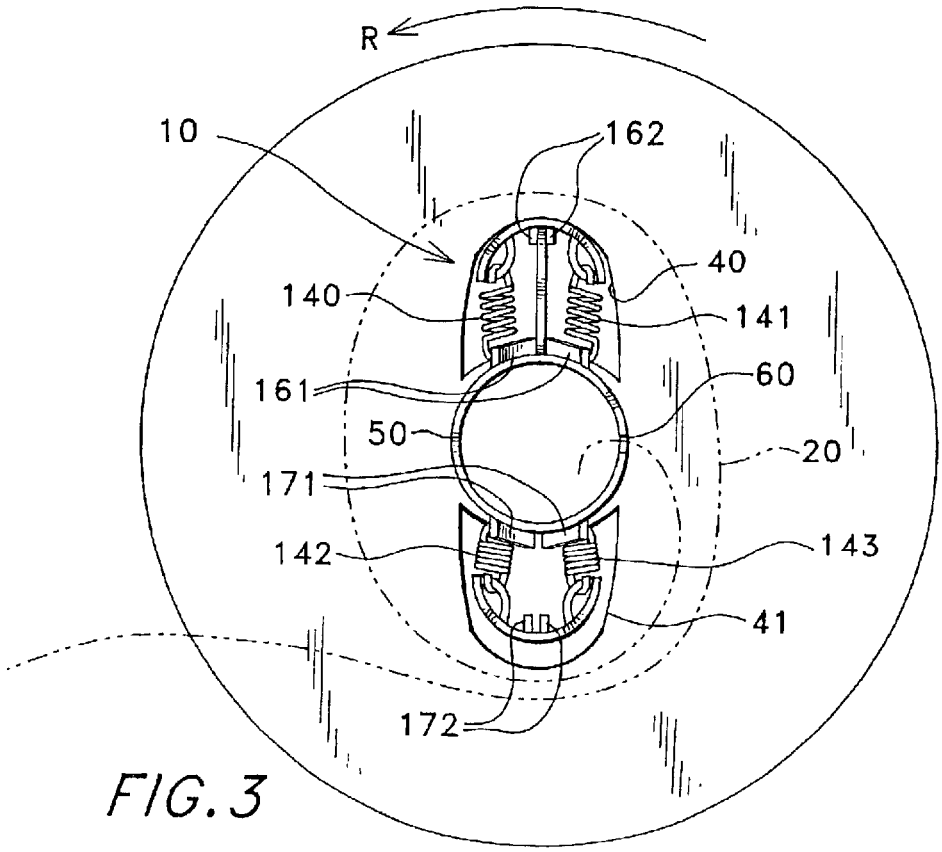
FIG. 3 is a frontal end view of the fence winding reel of FIG. 1 showing the placement of an end of a wire into a starter groove.

FIG. 3 is a front end view of fence winding reel 10 wherein the dotted lines depict wire fence 20. An end of wire fence 20 is placed into starter groove 60 of main frame 50. Fence winding reel 10 is rotated in direction R to retrieve a wire fence 20 off ground surface S. Wedge 30 is shown inserted into wedge runner guide 160 between a first portion 161 and a second portion 162. First portion 161 is located along the length of main frame 50. Second portion 162 is located along the adjacent length of expander 40. Wedge runner guide 170 having a first portion 171 and a second portion 172 holds wedge 31 (not shown) in place. First portion 171 is located along the length of main frame 50 and second portion 172 is located along the length of expander 41

FIG. 4 shows reel 10 in an assembled configuration. Expanders 40 and 41 are connected through backing plate 100 and hinged to mounting flange 110 at expander hinges 115 and 116, respectively at hinged ends 113, 114. Mounting pin 120 is shown in an inserted position connecting fence winding reel 10 to auger motor 130. Fence wire 20 is inserted into starter groove 60. Wedges 30, 31 hold expanders 40, 41 away from main frame 50. Fence winding reel 10 is used to spool or unspool fence 20 depending on the direction of auger rotation $R_A$.

Figure 5:
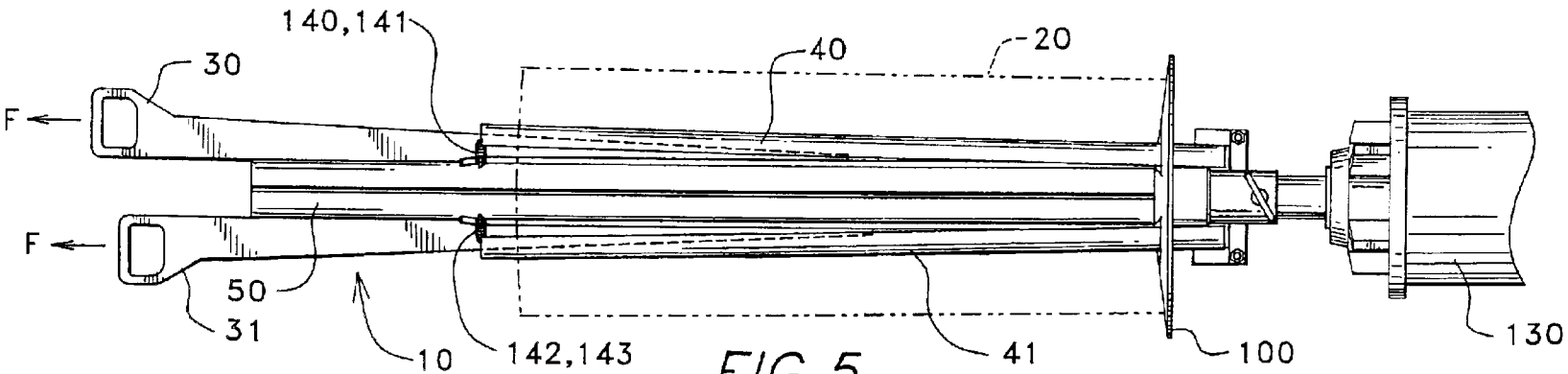
FIG. 5 is the same view as FIG. 4 showing the removal of the wedges and narrowing of the core to the contracted position.

FIG. 5 is the same view of reel 10 as FIG. 4. Here, the dotted lines depict wire fence 20 in a spooled configuration. Wedges 30, 31, which are used to hold expanders 40, 41 away from main frame 50, are shown being removed from fence winding reel 10 in direction F. The spacing provided by expander springs 140, 141 between main frame 50 and expander 40 is narrowed as wedge 30 is removed in direction F. The spacing provided by expander springs 142, 143 between main frame 50 and expander 41 is narrowed as wedge 31 is removed in direction F.

Figure 6:
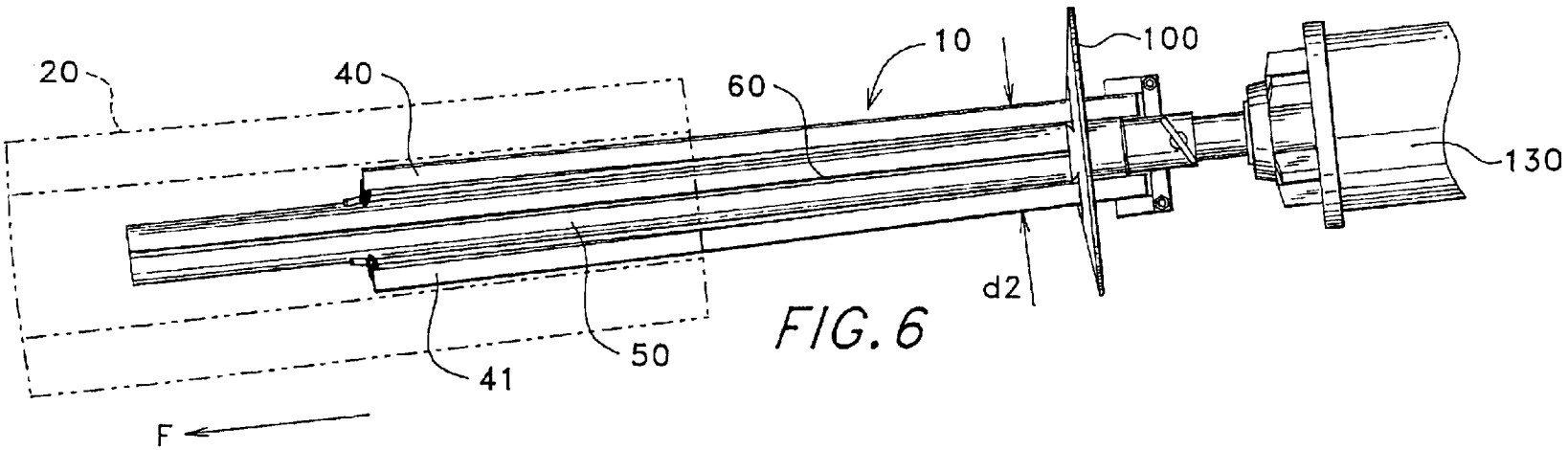
FIG. 6 is a side plan view of the preferred embodiment showing the removal of a wound fence coil from the reel apparatus which is in the contracted position.

FIG. 6 is a side plan view of reel 10 showing the removal of spooled fence 20 which is depicted by dotted lines. After wedges 30, 31 have been removed from reel 10, narrowing the spacing between main frame 50 and expanders 40, 41, wherein the core is in a contracted position, d2, fence 20 is slid off reel 10 in direction F. The end portion of fence 20, which is engaged in starter groove 60, is slid out of the open end of groove 60 located along the length of main frame 50.

Figure 7:
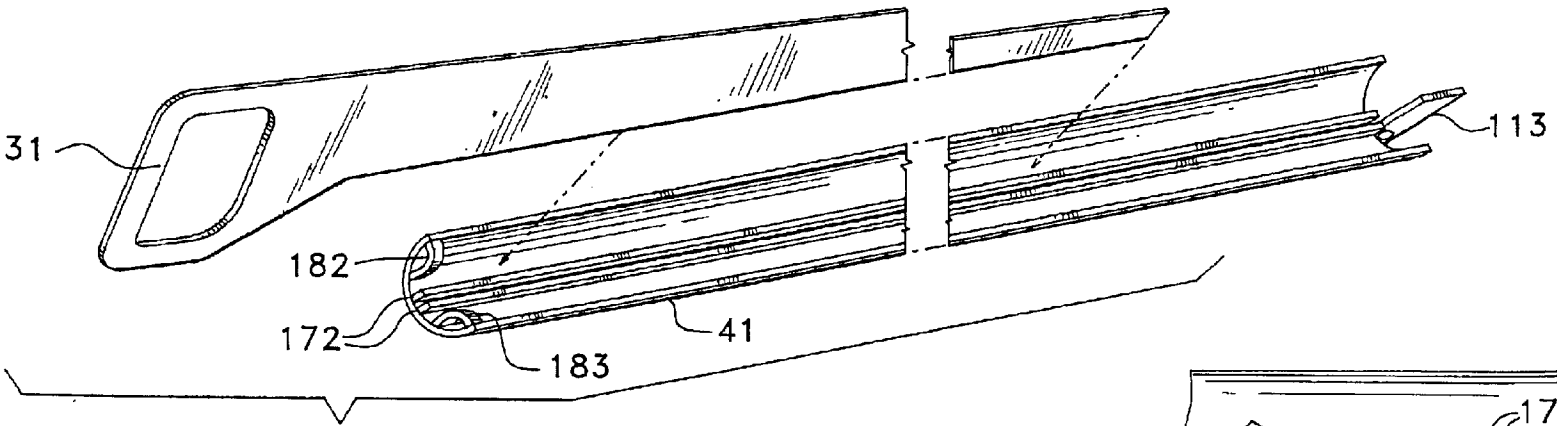
FIG. 7 is an exploded view of a wedge and a wedge runner guide assembly.
Figure 8:
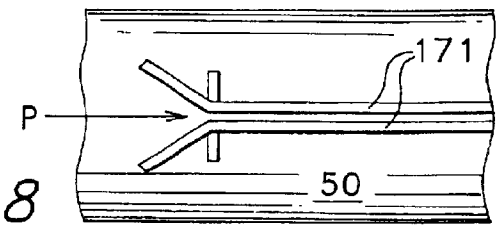
FIG. 8 is a close-up side plan view of the wedge runner guide.

FIGS. 7 and 8 illustrate how a wedge is placed into a wedge runner guide assembly. FIG. 7 shows wedge 31 and second portion 172 of wedge runner guide assembly 170 located along the length of expander 41. FIG. 8 shows first portion 171 of wedge runner guide 170 located along the length of main frame 50. In operation, wedge 31 is inserted in direction P into a guide space created when the first and second portions of the wedge runner guide align so that it is positioned between expander 41 and frame 50. Expander springs 142, 143 connect expander 41 to main frame 50 by means of spring loops 182, 183. Although not shown, wedge 30 engages expander 40 in a similar way. Therefore, expander springs 140, 141 connect expander 40 to main frame 50 by means of spring loops 180, 181 (not shown). Hinged end 113 acts as a stopper when inserting wedge 31. Similarly, hinged end 114 acts as a stopper for wedge 30.

Figure 9:
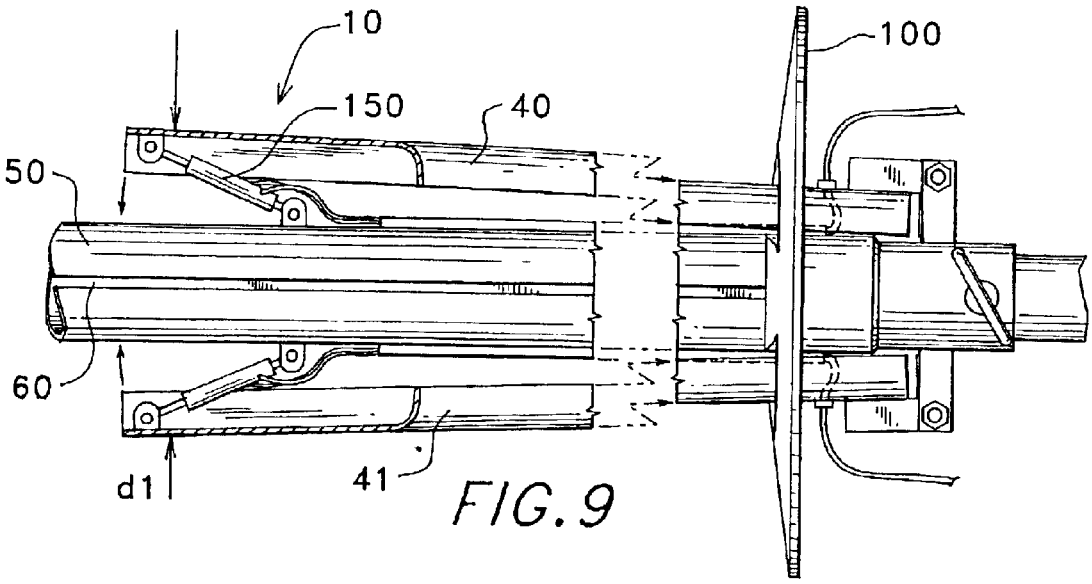
FIG. 9 is a side plan view of the fence winding reel apparatus using hydraulic cylinders, an alternate embodiment shown with the core in the expanded position.
Figure 10:
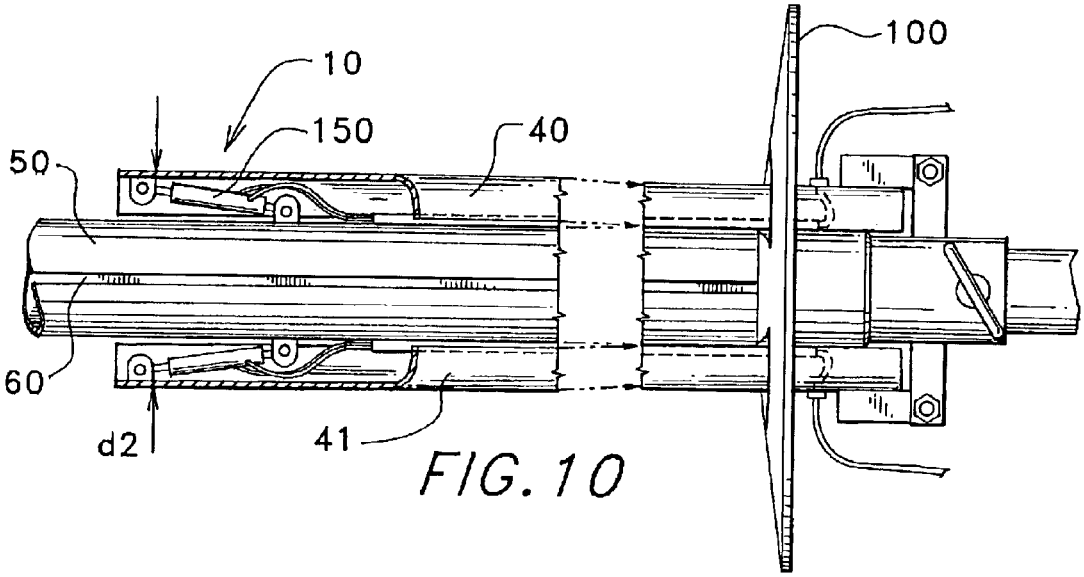
FIG. 10 is the same view as FIG. 9 with the core in the contracted position.

FIGS. 9 and 10 are side plan views of another embodiment of reel 10. In this example, hydraulic means are used to facilitate the fence winding operation. FIG. 9 shows reel 10 in an expanded position. Hydraulic means 150 are used to hold expanders 40, 41 out at an expanded core position, d1, of main frame 50 having starter groove 60. FIG. 10 shows reel 10 in an unexpanded or contracted position, d2.

Figure 11:
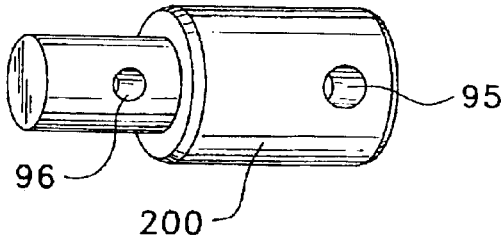
FIG. 11 is a side perspective view of an adapter for adapting the reel for use in conjunction with a specific auger drive assembly.
Figure 13:
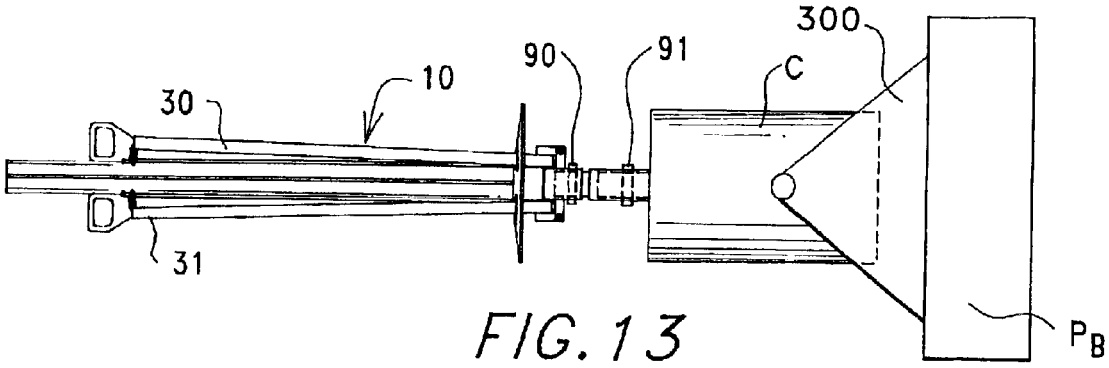
FIG. 13 is a side perspective view of reel 10 mounted to round shaft earth auger fixture C.

FIG. 11 is a side perspective view of adapter 200 for adapting reel 10 for use in conjunction with a round shaft earth auger fixture C (See FIG. 13).

FIG. 12A is a front view of backing plate $P_B$ which has been modified to engage auger fixture A. FIG. 12B is a side perspective view of reel 10 in which backing plate $P_B$ has been modified to accommodate auger fixture A. Auger fixture A is mounted to backing plate $P_B$ by inserting mounting pins 70, 71 (See FIG. 12B) through mounting pin holes 75,76 (See FIG. 12A) which are located on two adjacent plates of a trapezoidal front portion 300 of the backing plate $P_B$. As shown, a stopper plate 80 may be welded onto backing plate $P_B$ at a location between the plates of front portion 300 and below pin holes 75, 76 to support auger A out in a horizontal position.

FIG. 13 is a side perspective view of reel 10 mounted to round shaft earth auger fixture C, which is shown mounted to backing plate $P_B$ by mounting pins 90, 91 through mounting pin holes 95,96 (See FIG. 11) located on an auger adapter 200. Auger fixture C is mounted between two adjacent plates of trapezoidal front portion 300 of the backing plate $P_B$.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A reel attachable to a rotating drive assembly, said reel comprising:

a connector to a rotating drive assembly;

a central frame fastened to the connector forming a rotatable assembly;

said rotatable assembly having a first hinge base;

a first expanding core member pivotally connected to the first hinge base;

a first wedge sized to fit between the central frame and the first expanding core member;

wherein said first expanding core member, said first wedge, and said rotatable assembly form a reel having a contracted position when the first wedge is removed, and having an expanded position when the first wedge is inserted, thereby providing a fence winding reel that can contract its core size to enable a fence winding to be removed; and wherein the first expanding core member further comprises a longitudinal cylindrical segment having a wedge groove in its inside concave surface.

2. The reel of claim 1, wherein the central frame further comprises a cylindrical body having a wedge groove.

3. The reel of claim 2, wherein the wedge further comprises a flat, tapered body which slidably engages the cylindrical body wedge groove and the longitudinal cylindrical segment wedge groove.

4. The reel of claim 1, wherein the rotatable assembly further comprises a backing plate.

5. The reel of claim 4, wherein the backing plate further comprises a mount between the first hinge base and a distal end of the rotatable assembly, wherein the first expanding core member moves in an opening in the backing plate.

6. The reel of claim 1, wherein the first expanding core member further comprises an expander spring to tension the first expanding core member against the rotatable assembly.

7. The reel of claim 1 further comprising a second hinge base connected to the rotatable assembly, a second core member pivotally connected to the second hinge base, and a second wedge.

* * * * *